US011502431B1

(12) United States Patent
Leme et al.

(10) Patent No.: US 11,502,431 B1
(45) Date of Patent: Nov. 15, 2022

(54) TERMINAL HAVING A BOLT SECTION

(71) Applicants: TE Connectivity Germany GmbH, Bensheim (DE); TE Connectivity Brasil Industria De Eletronicos LTDA, Braganca Paulista (BR)

(72) Inventors: Rafael Kazuo Sato T Leme, Braganca Paulista (BR); Djalma Oliveira, Braganca Paulista (BR); Paulo Barletta, Braganca Paulista (BR); Jochen Mayer, Heimstetten (DE)

(73) Assignees: TE CONNECTIVITY GERMANY GMBH; TE CONNECTIVITY BRASIL INDUSTRIA DE ELETRONICOS LTDA

( * ) Notice: Subject to any disclaimer, the term of this patent is extended or adjusted under 35 U.S.C. 154(b) by 0 days.

(21) Appl. No.: 17/242,401

(22) Filed: Apr. 28, 2021

(51) Int. Cl.
*H01R 11/12* (2006.01)
*H01R 4/34* (2006.01)

(52) U.S. Cl.
CPC ..... *H01R 11/12* (2013.01); *H01R 4/34* (2013.01)

(58) Field of Classification Search
CPC ..... H01R 11/12; H01R 4/34; H01R 11/282; H01R 11/283; H01R 11/285; H01R 11/287
See application file for complete search history.

(56) References Cited

U.S. PATENT DOCUMENTS 5,249,989 A * 10/1993 Alsch ..... H01R 4/301 439/813
5,346,408 A * 9/1994 Chupak ..... H01R 11/284 439/522
5,453,027 A * 9/1995 Buell ..... H01R 4/2479 439/433
5,863,227 A * 1/1999 Bell, Jr. ..... H01R 11/12 439/883

FOREIGN PATENT DOCUMENTS

WO WO-2019206354 A1 * 10/2019 ..... H01R 11/12

* cited by examiner

*Primary Examiner* — Travis S Chambers

(57) ABSTRACT

A terminal includes a body and a bolt section at a first end of the body. The bolt section has a body passageway extending through the body and a sidewall defining the body passageway. The bolt section has a rib disposed on the sidewall and protruding into the body passageway.

17 Claims, 7 Drawing Sheets

TERMINAL HAVING A BOLT SECTION

FIELD OF THE INVENTION

The present invention relates to a terminal and, more particularly, to a terminal having a bolt section receiving a bolt.

BACKGROUND

In many applications, a terminal such as a ring terminal is mechanically and electrically connected to another element by a bolt. The bolt extends through a passageway of the ring terminal to screw into the element and, when fully attached, the ring terminal is held between the element and the head of the bolt. The bolt is initially separate from the ring terminal and is simply inserted through the passageway of the ring terminal to form the connection with the element. The installation, consequently, requires the inventory and assembly of two separate parts, which increases costs and assembly time and decreases efficiency by risking misplacement of one of the parts.

To address these issues, some ring terminals attach a widely available nut to the terminal at the passageway, which allows the bolt to be pre-positioned in the nut prior to installation. These arrangements, however, have fixation elements that are complex and costly to produce, for example a plurality of arms that are bent onto the nut to hold it in place at the passageway of the terminal, or require time-consuming and costly production steps, for example by welding the nut in place at the passageway.

SUMMARY

A terminal includes a body and a bolt section at a first end of the body. The bolt section has a body passageway extending through the body and a sidewall defining the body passageway. The bolt section has a rib disposed on the sidewall and protruding into the body passageway.

BRIEF DESCRIPTION OF THE DRAWINGS

The invention will now be described by way of example with reference to the accompanying Figures, of which.

DETAILED DESCRIPTION OF THE EMBODIMENTS

Figure 1:
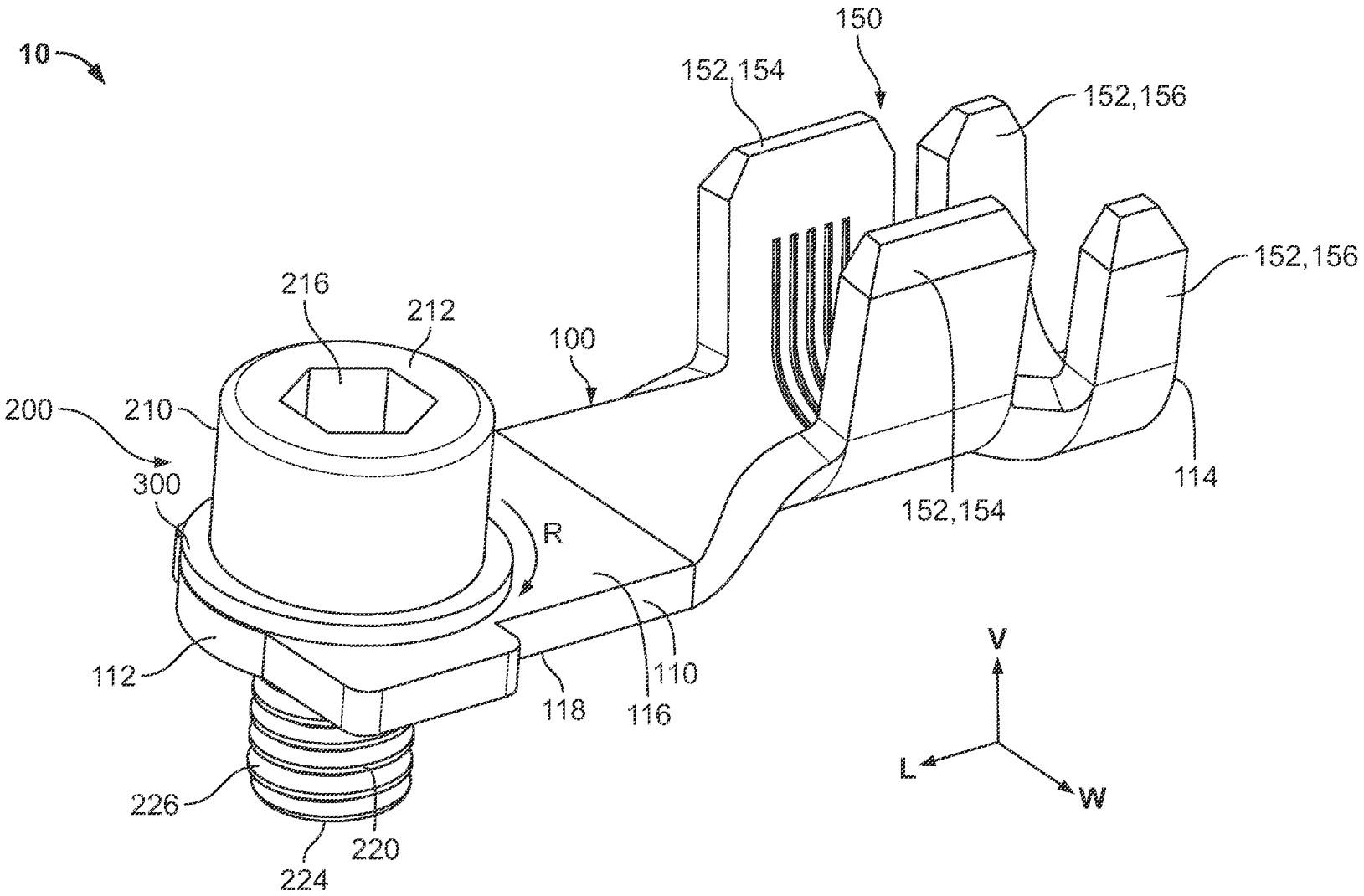
FIG. 1 is a perspective view of a terminal assembly according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Throughout the specification, directional descriptors are used such as "longitudinal", "width", and "vertical". These descriptors are merely for clarity of the description and for differentiation of the various directions. These directional descriptors do imply or require any particular orientation of the disclosed elements; an element extending in the "vertical direction" perpendicular to another element, for example, only needs to extend perpendicularly to the other element and does not need to be positioned vertically in three-dimensional space in order to fall within the scope of the present disclosure.

A terminal assembly 10 according to an embodiment, as shown in FIG. 1, includes a terminal 100 and a bolt 200 removably secured to the terminal 100. In the shown embodiment, the terminal assembly 10 includes a washer 300 disposed between the bolt 200 and the terminal 100. In other embodiments, the washer 300 can be omitted.

Figure 2:
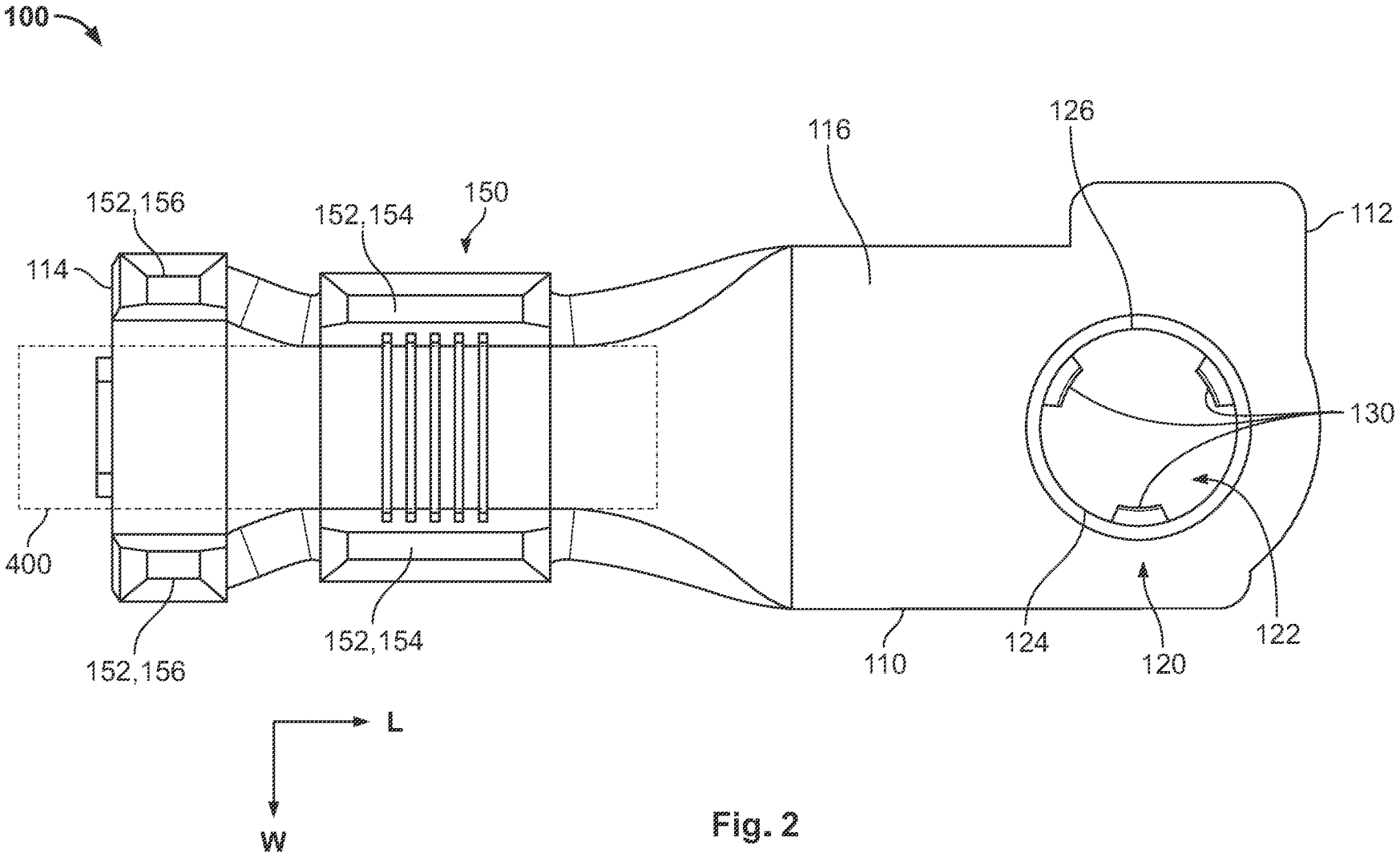
FIG. 2 is a plan view of a terminal of the terminal assembly.

The terminal 100, as shown in FIGS. 1 and 2, has a body 110 extending from a first end 112 to a second end 114 along a longitudinal direction L. The body 110 has an upper surface 116 and a lower surface 118 opposite to the upper surface 116 in a vertical direction V perpendicular to the longitudinal direction L.

Figure 3:
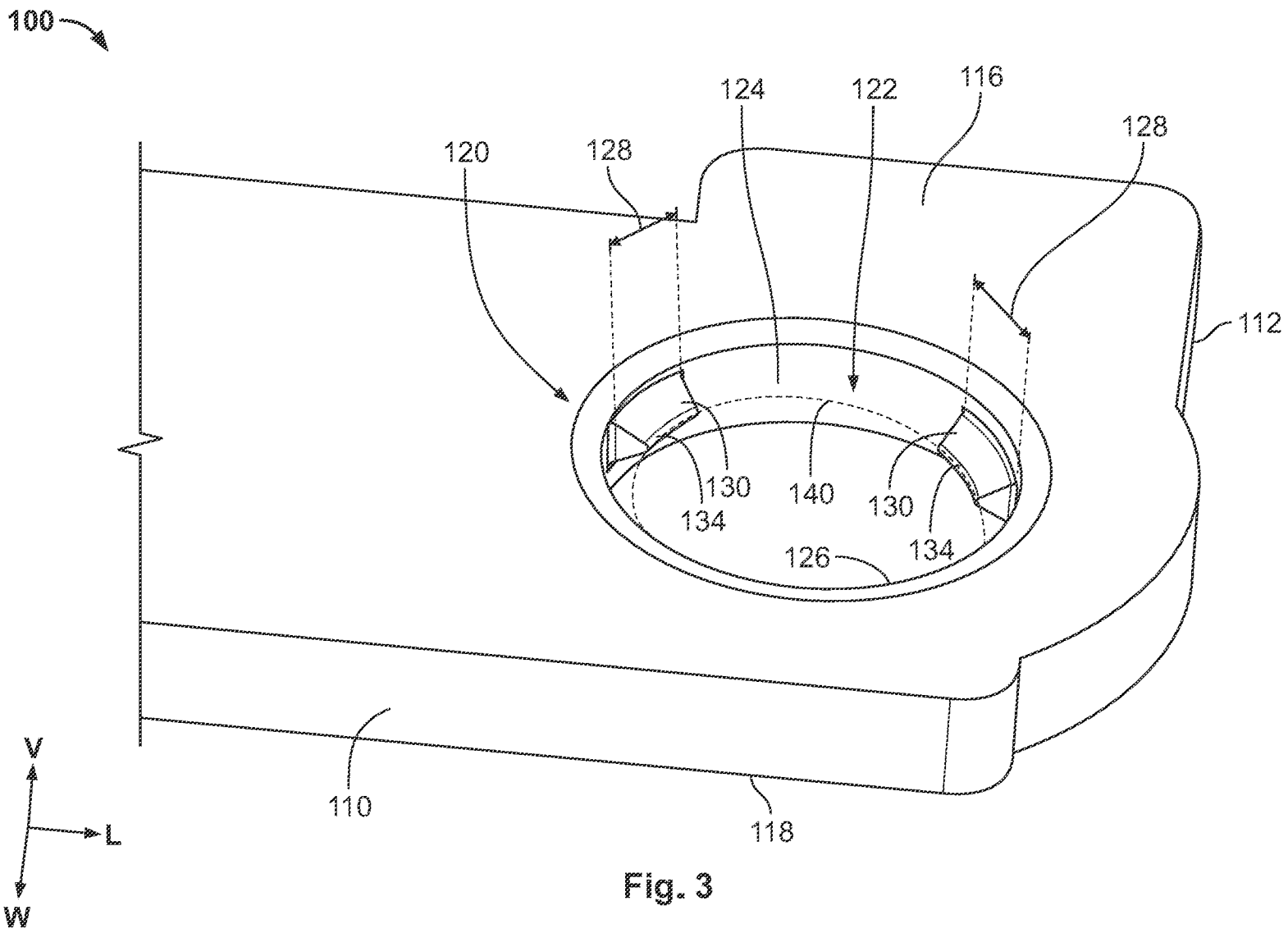
FIG. 3 is a detail perspective view of a bolt section of the terminal.
Figure 4:
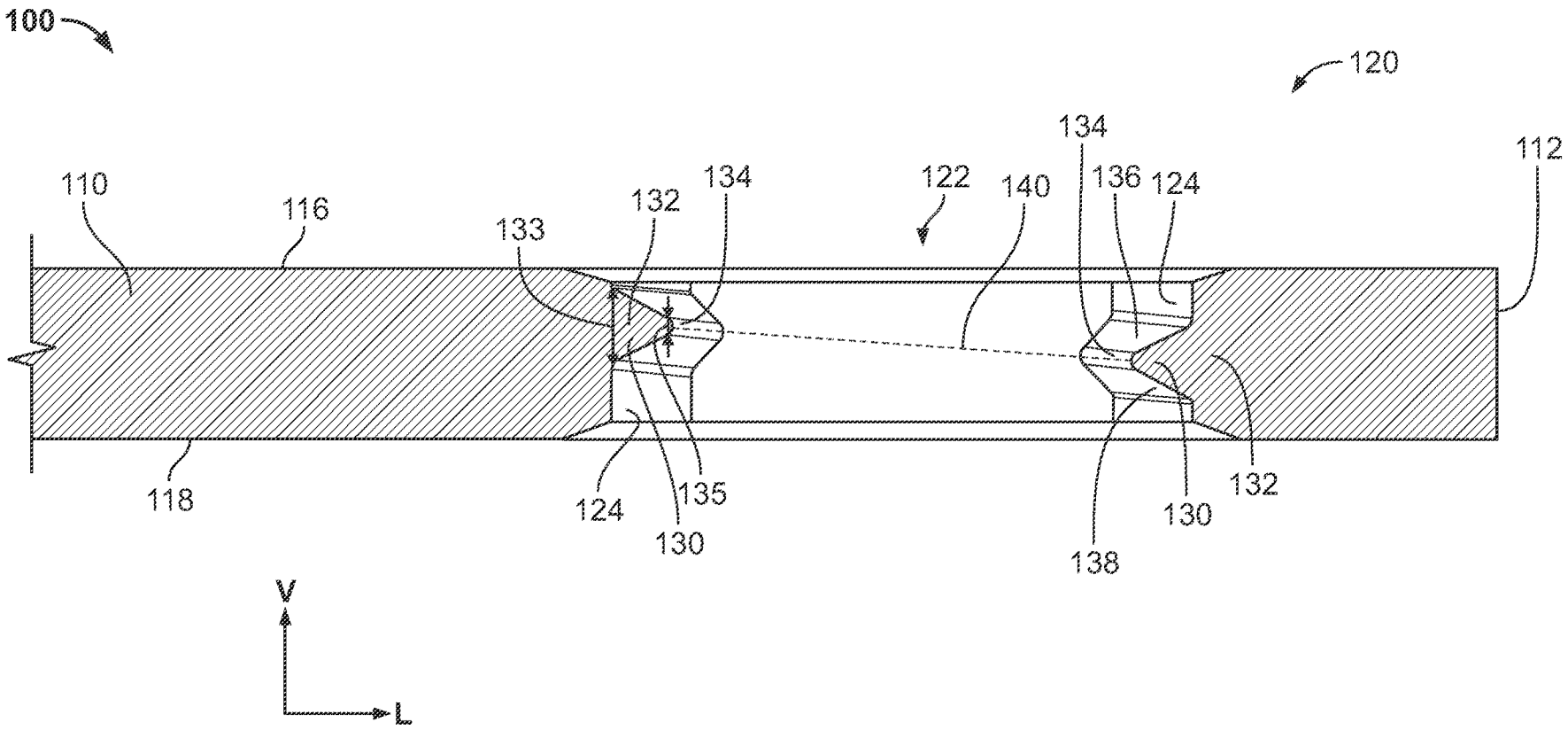
FIG. 4 is a detail sectional side view of the bolt section.

The terminal 100 has a bolt section 120 at the first end 112, as shown in FIGS. 2-4. The bolt section 120 has a body passageway 122 extending through the body 110 in the vertical direction V from the upper surface 116 to the lower surface 118. The bolt section 120 has a sidewall 124 extending around and defining the body passageway 122. In the shown embodiment, the sidewall 124 has a circular shape and a circumference 126 of the sidewall 124 encloses the body passageway 122.

The bolt section 120, as shown in FIGS. 2-4, has a plurality of ribs 130 disposed on the sidewall 124 and protruding into the body passageway 122. Each of the ribs 130 extends along a portion 128 of the circumference 126 of the sidewall 124 that is less than an entirety of the circumference 126 of the sidewall 124. The ribs 130 are separated and spaced apart from one another along the circumference 126. In the shown embodiment, the ribs 130 are evenly spaced around the circumference 126. In other embodiments, the ribs 130 may be unevenly spaced around the circumference 126.

In the embodiment shown in FIGS. 2-4, the bolt section 120 has three ribs 130. In other embodiments, the bolt section 120 could have one rib 130, two ribs 130, or more than three ribs 130, provided the rib 130 or ribs 130 can engage the bolt 200 as described in detail below.

As shown in FIG. 4, each of the ribs 130 has a base 132 connected to the side wall 124 and an edge 134 distal from the sidewall 124. The edge 134 extends along a helical path 140, shown in FIGS. 3 and 4, that spirals around the vertical direction V and extends through the body passageway 122. The edge 134 of each of the ribs 130 extends along only a portion of the helical path 140, as the rib 130 is only positioned along the portion 128 of the circumference 126 of the sidewall 124. In an embodiment in which the bolt section 130 has more than one rib 130, the edge 134 of each of the ribs 130 lies along the same helical path 140.

In the embodiment shown in FIG. 4, the edge 134 has an edge thickness 135 in the vertical direction V that is less than a base thickness 133 of the base 132 in the vertical direction V. The ribs 130 in the embodiment shown in FIG. 4 each have a first sloped surface 136 and a second sloped surface 138 opposite the first sloped surface 136 in the vertical direction V. The first sloped surface 136 and the second sloped surface 138 extend from the base 132 and intersect at the edge 134. In other embodiment, the ribs 130 may have a flat surface parallel to the upper surface 116 and the lower surface 118 of the body 110 in lieu of either the first sloped surface 136 or the second sloped surface 138, or in lieu of both the first sloped surface 136 and the second sloped surface 138.

The terminal 100 has a connection section 150 at the second end 114 of the body 110, as shown in FIGS. 1 and 2. The connection section 150 is adapted to connect to an external element 400, shown schematically in FIG. 2, to mechanically and electrically connect the external element 400 to the terminal 100.

In the embodiment shown in FIGS. 1 and 2, the connection section 150 has a plurality of crimping wings 152 for crimping the external element 400 to the body 110 of the terminal 100. The plurality of crimping wings 152 include a pair of conductor crimping wings 154 extending from the body 110 opposite one another in a width direction W perpendicular to the longitudinal direction L and the vertical direction V. In the shown embodiment, the plurality of crimping wings 152 include a pair of insulation crimping wings 156 opposite one another in the width direction W and positioned closer to the second end 114 than the conductor crimping wings 154 along the longitudinal direction L.

In an embodiment in which the external element 400 is a wire, the conductor crimping wings 154 are crimped over and mechanically and electrically connected to a conductor of the wire, while the insulation crimping wings 156 are crimped over and mechanically connected to an insulation of the wire. In another embodiment, the insulation crimping wings 156 can be omitted.

In other embodiments, instead of having the crimping wings 152, the connection section 150 may be a section of the body 110 adapted to be welded to the external element 400, in an embodiment in which the external element 400 is a bus bar, or may be any other type of section capable of mechanically and electrically connecting the body 110 to the external element 400.

In an embodiment, the terminal 100 is monolithically formed in a single piece including at least the body 110, the sidewall 124, and the ribs 130. The terminal 100 may be stamped from a sheet of metal and formed into the shape shown in FIGS. 1 and 2. In another embodiment, the terminal 100 may be formed in a plurality of pieces and assembled together. The terminal 100 may be formed from copper, brass, or any other type of conductive material.

Figure 5:
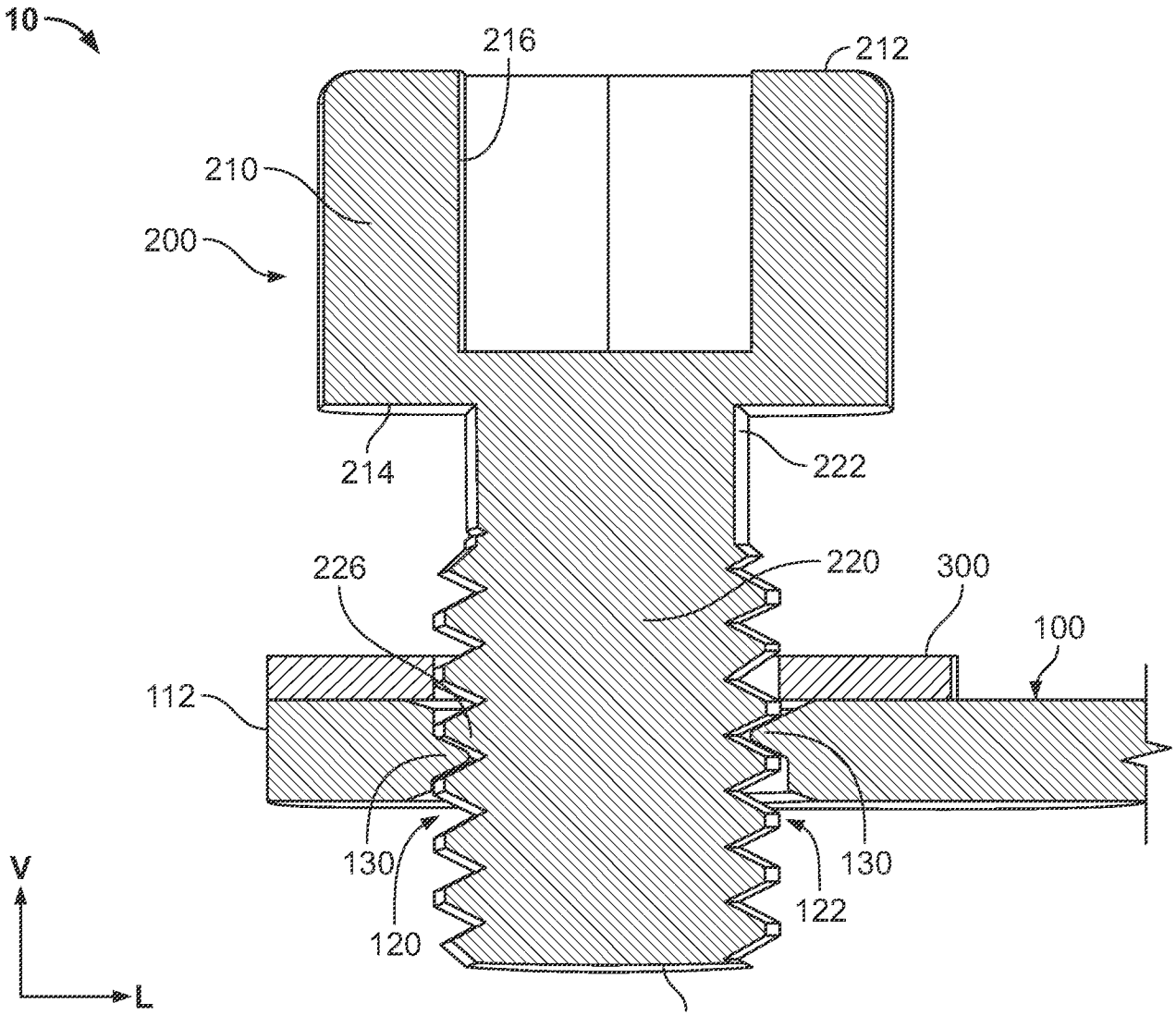
FIG. 5 is a detail sectional side view of the bolt section with a bolt partially screwed into the bolt section.
Figure 6:
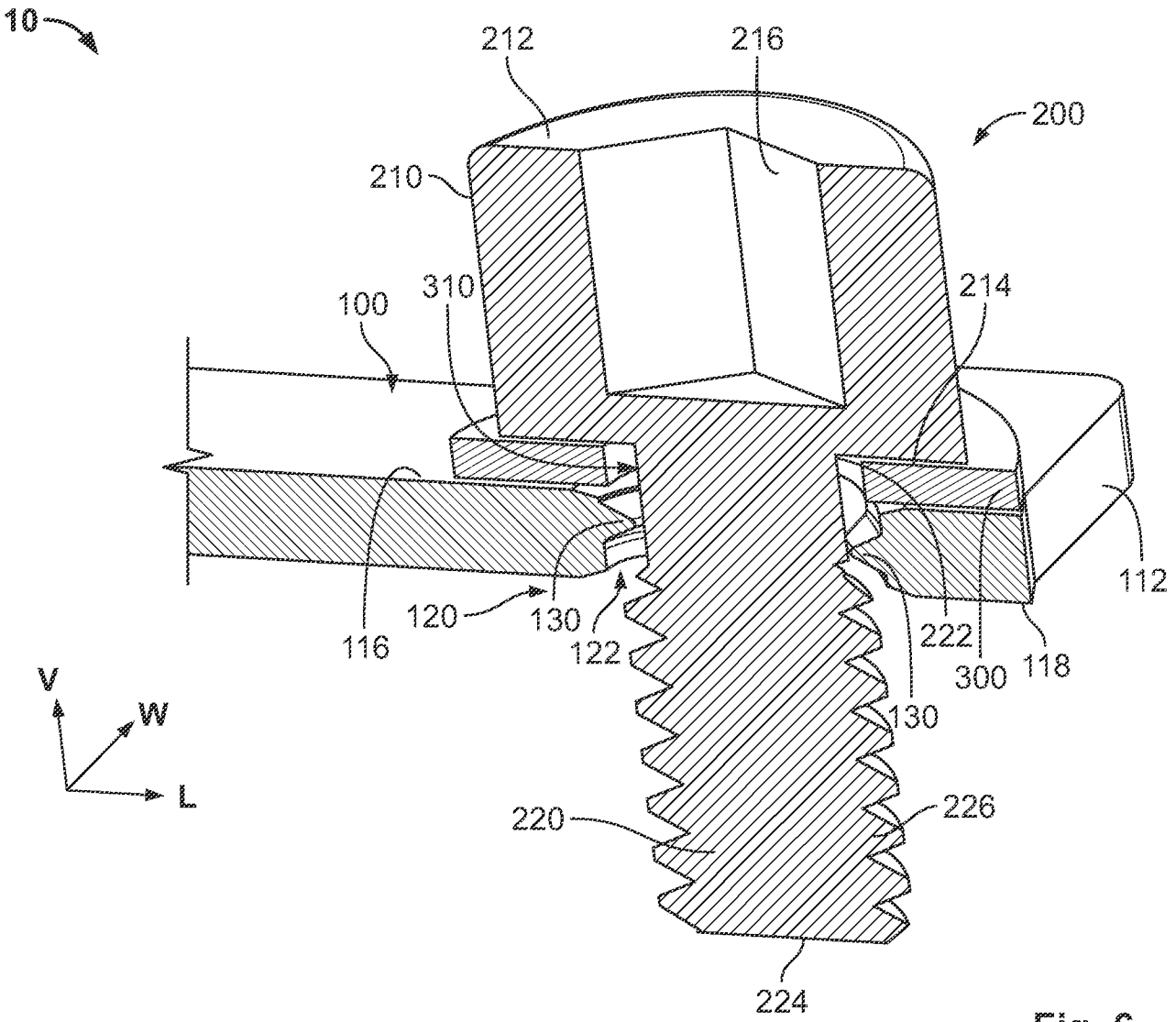
FIG. 6 is a detail sectional perspective view of the bolt section with the bolt fully screwed into the bolt section.

The bolt 200, as shown in FIGS. 1, 5, and 6, has a head 210 and a shaft 220 extending from the head 210 along the vertical direction V. The head 210 has an outer surface 212 and an inner surface 214 opposite the outer surface 214 along the vertical direction V. The outer surface 212 has a drive section 216 capable of being engaged by a tool that is used to rotate the bolt 200 about a rotational direction R shown in FIG. 1. In the shown embodiment, the drive section 216 is internal on the head 210 and is formed by a passageway extending into the outer surface 212. In another embodiment, the drive section 216 can be external on the head 210 and can be formed by the outer surface 212.

As shown in FIGS. 5 and 6, the shaft 220 extends from the inner surface 214 of the head 210 along the vertical direction V. The shaft 220 has a first end 222 connected to the inner surface 214 and a second end 224 opposite the first end 222 along the vertical direction V. The shaft 220 has an external thread 226 protruding from the shaft 220 and extending along a helical path from the first end 222 to the second end 224.

In an embodiment, the bolt 200 is monolithically formed in a single piece. In another embodiment, the bolt 200 can be formed in a plurality of pieces and assembled together. The bolt 200 may be formed of a type of steel or any other type of conductive material.

The washer 300, in the embodiment shown in FIGS. 1, 5, and 6, is a flat, circular element formed of a conductive material and having a washer passageway 310 extending centrally through the washer 300 along the vertical direction V. In other embodiments, the washer 300 may be any type of washer commonly used with bolts.

The assembly of the terminal assembly 10 will now be described in greater detail primarily with respect to FIGS. 1, 5, and 6.

The bolt 200 is positioned with the second end 224 of the shaft 220 in the body passageway 122 and is screwed into the bolt section 120 of the terminal 100 to a position shown in FIGS. 1 and 6. A tool engages the drive section 216; rotation of the tool about the rotational direction R rotates the bolt 200 about the rotational direction R. The rotational direction R is shown as a clockwise direction in FIG. 1 but could alternatively be a counterclockwise direction.

The ribs 130 of the bolt section 120, as shown in FIG. 5, engage the shaft 220 of the bolt 200 between the turns of the external thread 226. The helical path 140 of the edges 134 of the ribs 130 is complementary to a helical path of the external thread 226 and, as the bolt 200 is rotated about the rotational direction R, the ribs 130 remain engaged with the external thread 226 while the external thread 226 rotates along the ribs 130 and the shaft 220 moves deeper into the body passageway 122 along the vertical direction V.

The ribs 130 act like the inner thread of a nut to receive and removably secure the bolt 200 in the body passageway 122, as shown in FIGS. 5 and 6. When the bolt 200 is screwed into the body passageway 122 by rotation along the rotational direction R, the ribs 130 secure the bolt 200 to the terminal 100 in the body passageway 122, at any depth of insertion along the vertical direction V including the position shown in FIG. 5 or the position shown in FIG. 6. The terminal assembly 10 can be moved without risk of the bolt 200 becoming separated from the terminal 100. The bolt 200 can also be screwed counter to the rotational direction R to disengage the bolt 200 from the ribs 130 and permit removal of the bolt 200 from the body passageway 122; the bolt 200 is removably securable in the body passageway 122 by the ribs 130.

In an embodiment in which the terminal assembly 10 includes the washer 300, the second end 224 of the shaft 220 is inserted into the washer passageway 310 and the washer 300 is positioned around the shaft 220 in abutment with the inner surface 214 of the head 210. The bolt 200 with the washer 300 is then inserted and screwed into the bolt section 120 as described above, reaching the position shown in FIGS. 1 and 6 in which the washer 300 is held between the upper surface 116 of the body 110 and the inner surface 214 of the head 210.

Figure 7:
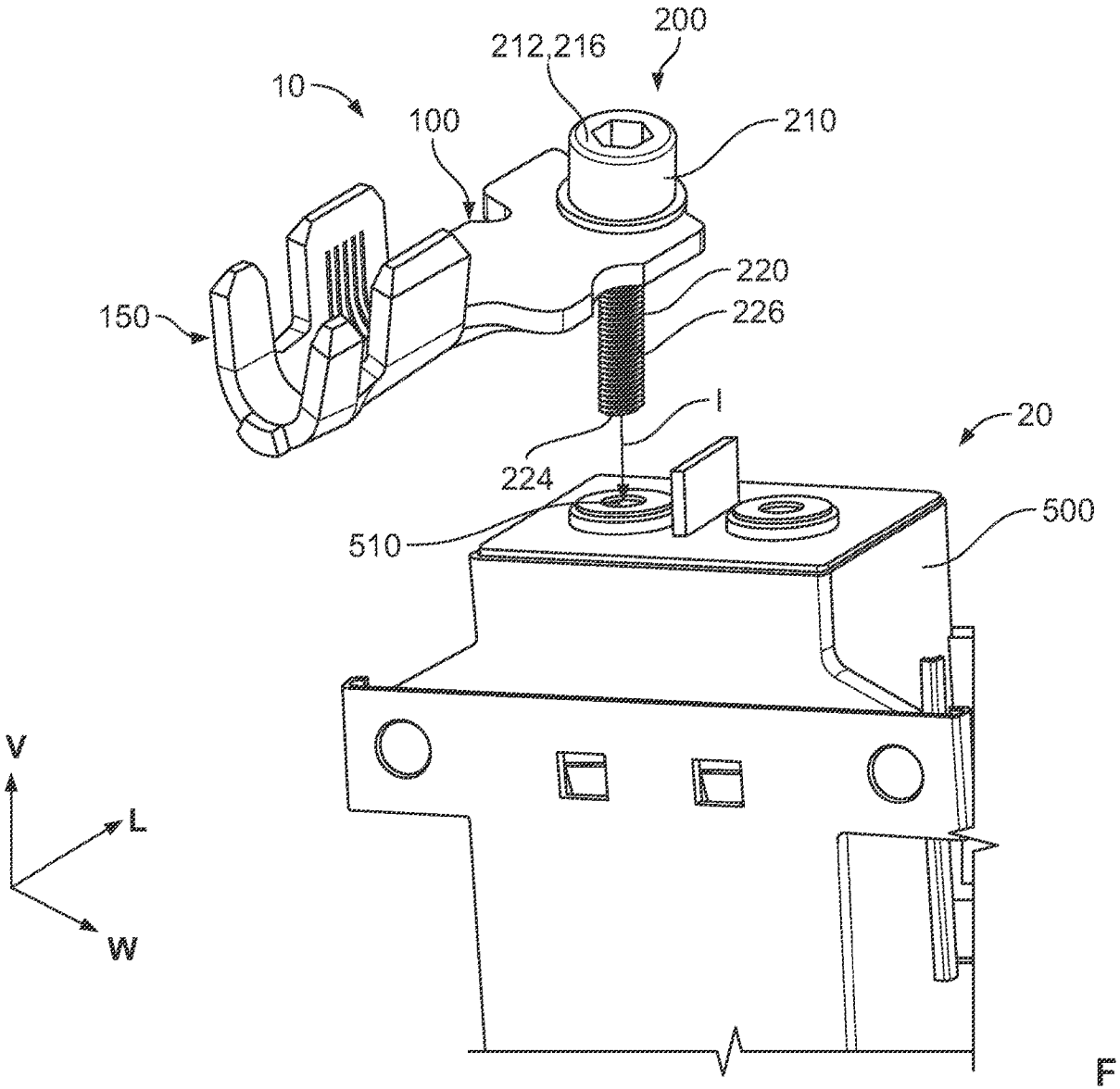
FIG. 7 is a perspective view of a contact assembly according to an embodiment.

The terminal assembly 10 can be used with an electrical component 500 as part of a contact assembly 20, as shown in FIG. 7. The electrical component 500 has a component passageway 510 that is threaded and defined by a conductive material. In an embodiment, the electrical component 500 is a relay contactor. In other embodiments, the electrical component 500 may be any type of component adapted to be electrically connected to a terminal by attachment via a bolt.

As shown in FIG. 7, with the bolt 200 removably secured in the bolt passageway 122 as described and shown above, the second end 224 of the shaft 220 is inserted along an insertion direction I into the component passageway 510 of the electrical component 500. A tool is used to rotate the drive section 216 of the head 210 and move the external thread 226 along the component passageway 510, mechanically and electrically connecting the bolt 200 with the component passageway 510 and electrically connecting the terminal 100 with the electrical component 500. The connection section 150, as described above and shown in FIG. 2, can be connected to the external element 400 to electrically connect the external element 400 to the electrical component 500.

In the terminal assembly 10 according to the invention, the at least one rib 130 in the bolt section 120 allows the bolt 200 to be pre-positioned and securely held in the body passageway 122 of the terminal 100 prior to installation on the electrical component 500. The rib 130 prevents unwanted separation of the bolt 200 and the terminal 100 while extending over just a portion of the circumference 126 of the sidewall 124 and being monolithically formed with the sidewall 124 and the body 110, avoiding requiring additional parts for installation and avoiding the time and costs associated with complex production and installation steps.

What is claimed is:

1. A terminal, comprising:

a body; and a bolt section at a first end of the body, the bolt section has a body passageway extending through the body and a sidewall defining the body passageway, the bolt section has a rib including a base disposed on the sidewall and an edge distal from the sidewall and protruding into the body passageway, the rib having a first sloped surface and a second sloped surface opposite the first sloped surface, the first sloped surface and the second sloped surface extending from the base and intersecting at the edge, the rib extending along a helical path and along a portion of a circumference of the sidewall that is less than an entirety of the circumference of the sidewall.

2. The terminal of claim 1, wherein the edge has an edge thickness less than a base thickness of the base along a vertical direction extending through the body passageway.

3. The terminal of claim 1, wherein the rib is monolithically formed in a single piece with the sidewall and the body.

4. The terminal of claim 1, wherein the rib is one of a plurality of ribs disposed on the sidewall and protruding into the body passageway.

5. The terminal of claim 4, wherein the ribs are separated and spaced apart from one another along the circumference of the sidewall.

6. The terminal of claim 5, wherein an edge of each of the ribs distal from the sidewall extends along the helical path.

7. The terminal of claim 1, further comprising a connection section at a second end of the body opposite the first end, the connection section adapted to connect to an external element.

8. The terminal of claim 7, wherein the connection section has a plurality of crimping wings.

9. A terminal assembly, comprising:

a terminal having a body and a bolt section disposed at a first end of the body, the bolt section has a body passageway extending through the body and a sidewall defining the body passageway, the bolt section has a rib disposed on the sidewall and protruding into the body passageway, the rib defining at least a portion of an internal helical thread; and a bolt disposed in the body passageway and removably secured in the body passageway by the rib, the bolt having an external helical thread complementary to the rib, the rib and the external thread threadedly engaging to secure the bolt within the passageway.

10. The terminal assembly of claim 9, wherein the rib has a base connected to the sidewall and an edge distal from the sidewall, the edge extends along a helical path.

11. The terminal assembly of claim 9, wherein the rib extends along a portion of a circumference of the sidewall that is less than an entirety of the circumference of the sidewall.

12. The terminal assembly of claim 9, wherein the rib is monolithically formed in a single piece with the sidewall and the body.

13. The terminal assembly of claim 9, wherein the rib comprises:

a base connected to the sidewall;

an edge distal from the sidewall and extending along a helical path; and a first sloped surface and a second sloped surface opposite the sloped first surface, the first sloped surface and the second sloped surface extending from the base and intersecting at the edge.

14. The terminal assembly of claim 9, wherein the bolt has a shaft with the external thread.

15. The terminal assembly of claim 14, wherein the bolt is screwable into and out of the body passageway by rotational movement of the external thread along the rib.

16. A contact assembly, comprising:

an electrical component having a bolt passageway defining an internal helical thread; and a terminal assembly including a terminal and a bolt having an external helical thread, the terminal having a body and a bolt section disposed at a first end of the body, the bolt section has a body passageway extending through the body and a sidewall defining the body passageway, the bolt section has a rib disposed on the sidewall and protruding into the body passageway, the rib defining a portion of an internal helical thread, the bolt is disposed in the body passageway and removably secured in the body passageway by threadedly engaging with the rib, the bolt mechanically and electrically connects with the bolt passageway via threaded engagement between the internal and external helical threads.

17. The contact assembly of claim 16, wherein the rib comprises:

a base connected to the sidewall;

an edge distal from the sidewall and extending along a helical path; and a first sloped surface and a second sloped surface opposite the sloped first surface, the first sloped surface and the second sloped surface extending from the base and intersecting at the edge.

* * * * *